United States Patent [19]

Linge et al.

[11] Patent Number: 4,574,684

[45] Date of Patent: Mar. 11, 1986

[54] SECURING AND EJECTOR DEVICE ON AMMUNITION-STOWAGE SYSTEMS WITH STORAGE TUBES

[75] Inventors: Reiner Linge, Kassel; Uwe Sprafke, Schauenburg; Heinz-Jürgen Schlömer, Vellmar, all of Fed. Rep. of Germany

[73] Assignee: Wegmann & Co. GmbH, Kassel, Fed. Rep. of Germany

[21] Appl. No.: 560,023

[22] Filed: Dec. 9, 1983

[51] Int. Cl.[4] ..... F41C 25/00; F42B 37/00

[52] U.S. Cl. ..... 89/34; 206/3; 221/87

[58] Field of Search ..... 89/34, 36 K, 36 H; 188/67, 74; 221/87; 206/3; 312/45, 72

[56] References Cited

U.S. PATENT DOCUMENTS

| | | | |
|---|---|---|---|
| 1,710,621 | 4/1929 | Henderson | 221/87 X |
| 2,812,057 | 11/1957 | Brownfield | 221/87 |
| 3,033,419 | 5/1962 | Lebach | 221/87 |
| 3,444,780 | 5/1969 | Fusee | 89/34 |
| 4,487,104 | 12/1984 | Schiele et al. | 89/34 |

FOREIGN PATENT DOCUMENTS

| | | | |
|---|---|---|---|
| 3125406 | 2/1983 | Fed. Rep. of Germany | 206/3 |
| Ad.10329 | of 1898 | United Kingdom | 89/34 |
| Ad.3064 | of 1903 | United Kingdom | 89/34 |

*Primary Examiner*—David H. Brown

*Attorney, Agent, or Firm*—Sprung Horn Kramer & Woods

[57] ABSTRACT

In ammunition-stowage systems in which the shells are stored in storage tubes, the shells are to be prevented from being able to slide out of the storage tubes when severely shaken while on the other hand being easy to grasp for removal and withdrawal from the tubes. A securing and ejector device is positioned at every storage tube for this purpose. The device contains one stop each, which rests on the front of the rim of the shell and is subjected to spring force in such a way that the springs are compressed when the shell is inserted. A hook that can be shifted transversely against the force of a spring engages behind the rear of the base of the shell when a shell has been inserted. To remove a shell, the hook is shifted transversely until it releases the base of the shell, upon which the stop, which is subject to the force of a spring, thrusts the shell out at least as far as the length of the spring allows.

1 Claim, 5 Drawing Figures

SECURING AND EJECTOR DEVICE ON AMMUNITION-STOWAGE SYSTEMS WITH STORAGE TUBES

BACKGROUND OF THE INVENTION

The invention relates to a securing and ejector device on ammunition-stowage systems with storage tubes that the shells are inserted into. Ammunition-stowage systems of this type can positioned in the turret of a tank or other battle system for example. The shells must on the one hand be stored securely enough in the storage tubes to prevent them from sliding out even when severely shaken, when traveling off the road for example, while being easy to grasp for removal and withdrawal from the tubes. A securing and ejector device is positioned at every storage tube to satisfy both demands simultaneously.

SUMMARY OF THE INVENTION

A device that can be shifted longitudinally and has a stop that rests on the front of the rim of the shell and with a hook that can be shifted transversely against the force of a spring engaging behind the rear of the base of the shell is positioned as a securing and ejector device in accordance with the invention at each storage tube in the ammunition-stowage system, with the stop being capable of being shifted subject to the action of a spring to a specified extent to the rear. The hook that can be shifted transversely is positioned in such a way that it snaps into place behind the base of the shell only when the shell has been completely inserted, preventing the shell from falling out. If the hook is lifted manually so that it no longer engages behind the base of the shell, the stop is activated and withdraws, because of the spring force it is subjected to, the shell out of the storage tube at least as far as the range of the spring allows. The range of the spring is just long enough for the rear end of the shell, which is now projecting out of the storage tube, to be reliably grasped with the hands so that the shell can be extracted. To prevent the hook from interfering while the shell is being extracted, a guideway is practically provided on the stop that positively holds the hook up as long as the shell has not been inserted and completely releases the hook only when the shell has been inserted.

The stop that extracts the shell from the storage tube is practically connected to two rods that serve as guides and shift compression springs that are tensioned when the stop is shifted to the front and shift the stop along with the shell backward to an extent that is defined by a set collar when released by the hook. It should be noted that "forward" always means toward the side where the point of the shell is located and "backward" toward the side where the base of the shell is located in what follows. The two rods that the stop is connected to can be guided in two slide bearings, with the compression springs that are slid over the rods resting on the one hand against the forward slide bearing and on the other hand against set collars attached to the rods.

DETAILED DESCRIPTION OF THE INVENTION

Figure 1:
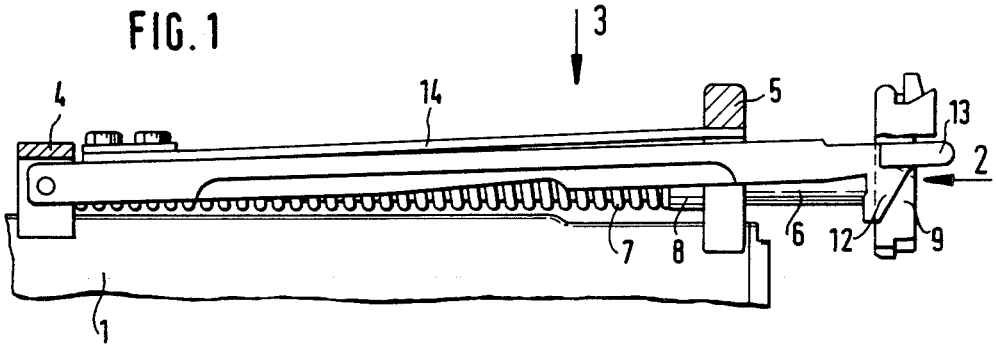
FIG. 1 is a side view of the rear end of a storage tube in an ammunition storage with a securing and ejector device in accordance with the invention.
Figure 2:
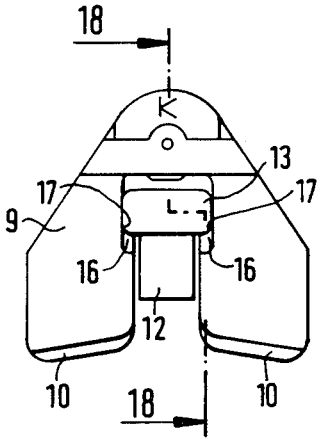
FIG. 2 is an end view of the stop in the direction indicated by arrow 2 in FIG. 1.
Figure 5:
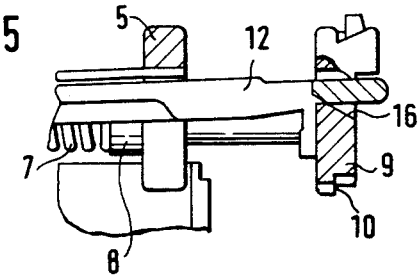
FIG. 5 is a partial section along line 18—18 in FIG. 2 with no shell inserted.
Figure 3:
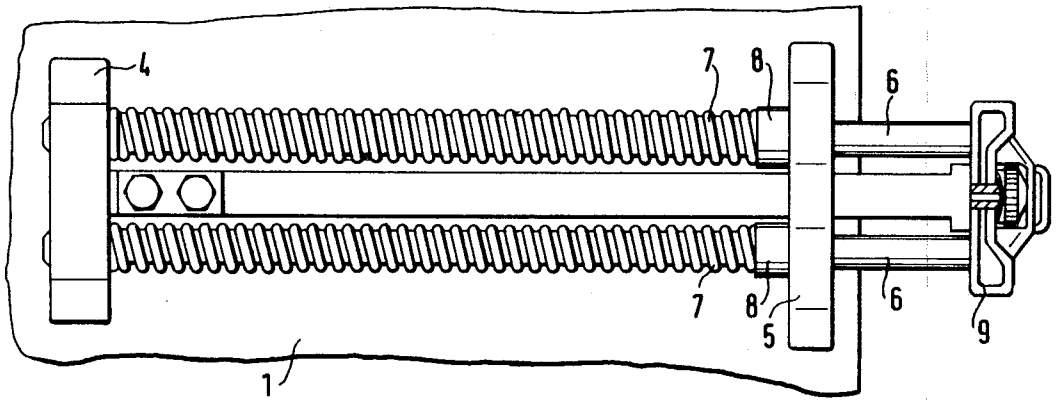
FIG. 3 is a top view of the securing and and ejector device in the direction indicated by arrow 3 in FIG. 1.
Figure 4:
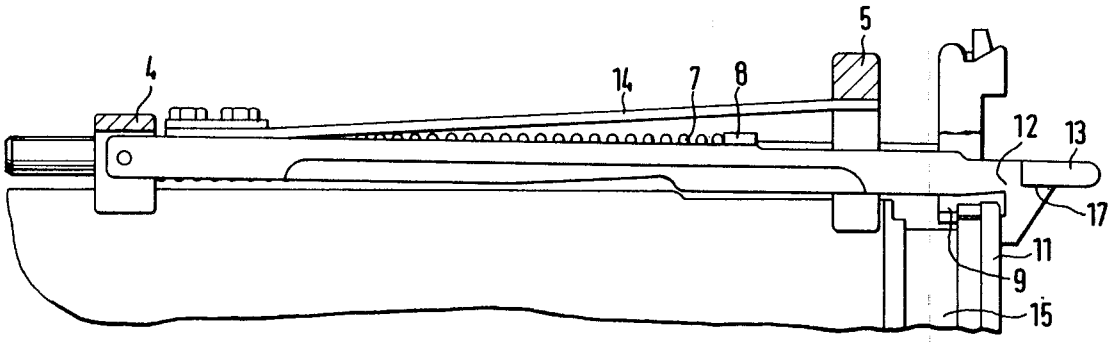
FIG. 4 illustrates the same situation as in FIG. 1 but with a shell inserted and secured.

The ammunition-stowage system partially illustrated in FIGS. 1 through 5 has two sliding bearings 4 and 5 attached to a storage tube 1. Two rods 6 slide in the bores of sliding bearings 4 and 5. A compression spring 7 has been thrust onto each rod 6 and rests on the one hand against sliding bearing 4 and on the other against a set collar 8 fastened on rods 6. A stop 9 is fastened to the ends of rods 6 that project beyond the rear end of storage tube 1. The edges 10 of the stop that face inward are shaped so that they can rest as will be evident from FIG. 4 against the projecting edge of the base 11 of the shell. A hook 12 with a handle 13 is also mounted on sliding bearing 4 and tensioned inward by a leaf spring 14 across the direction in which stop 9 moves. As will be evident from the figures, compression springs 7 force stop 9 into the position illustrated in FIGS. 1 and 3. When a shell 15 is inserted into storage tube 1 as illustrated in FIG. 4, the forward edge of shell base 11 will rest against stop 9 even before the shell has been completely inserted, and, as the shell continues to be inserted, stop 9 will, in conjunction with rods 6, be shifted foreward until hook 12 snaps into place behind shell base 11 as illustrated in FIG. 4. When the shell is removed, hook 12 is lifted by means of handle 13 until it no longer engages behind the base of the shell. This activates the tension of compression springs 7 and forces stop 9 back into the position illustrated in FIGS. 1 and 3, whereupon the shell is extracted from storage tube 1 so that its end can be grasped. To prevent hook 12 from getting in the way while the shell is being extracted, there is a support 16 on stop 9 and a guide 17 on hook 12 to secure the hook in its positively elevated position as long as no shell 15 has been inserted. The hook is completely released and secures the shell only when shell 15 has arrived at the position illustrated in FIG. 4.

We claim:

1. A device for securing ammunition in and ejecting ammunition from a storage tube having an open end wherein the ammunition is in the form of a shell having a base with an inner and an outer engaging surface, the device comprising: a slide bearing fixedly mountable on a storage tube at a distance from the open end of the tube; two parallel rods, each slidably mounted in the bearing at one end and having the other end disposed in the vicinity of the open end of the tube; a stop member connected to said other end of each and disposed in the path of a shell inserted into the rod open end of the tube, wherein the stop has an inner edge engageable with the inner engaging surface of a shell base being inserted in a tube; spring means disposed on each rod for urging the stop member away from the slide bearing; a hook; means pivotally mounting the hook for movement between a first position out of the path of movement of a shell inserted into the open end of a tube and a second position wherein the hook engages the outer engaging surface of a shell base and preventing longitudinal movement of the shell out of the tube in response to the urging of the spring means on the rods and thereby the stop member; second spring means urging the hook into the second position; a handle disposed on the hook for manually moving the hook from second position to the first position; and guide means disposed on the stop and the hook for maintaining the hook in the first position against the force of the second spring means until the stop is engaged by the inner engaging surface of a shell base and moved towards the slide bearing.

* * * * *